US010107015B2

(12) United States Patent
Geringer et al.

(10) Patent No.: US 10,107,015 B2
(45) Date of Patent: Oct. 23, 2018

(54) ELECTRIC LATCH RETRACTION PUSH-BAR DEVICE

(71) Applicant: 1 ADOLFO, LLC, Camarillo, CA (US)

(72) Inventors: Arthur V. Geringer, Oak Park, CA (US); David A. Geringer, Camarillo, CA (US)

(73) Assignee: SECURITY DOOR CONTROLS, Camarillo, CA (US)

( * ) Notice: Subject to any disclaimer, the term of this patent is extended or adjusted under 35 U.S.C. 154(b) by 452 days.

(21) Appl. No.: 14/538,621

(22) Filed: Nov. 11, 2014

(65) Prior Publication Data

US 2015/0137528 A1 May 21, 2015

Related U.S. Application Data

(63) Continuation-in-part of application No. 14/469,915, filed on Aug. 27, 2014, now Pat. No. 9,797,165, (Continued)

(51) Int. Cl.
*E05B 85/24* (2014.01)
*E05B 47/00* (2006.01)
(Continued)

(52) U.S. Cl.
CPC ..... *E05B 47/0012* (2013.01); *E05B 47/023* (2013.01); *E05B 63/0056* (2013.01);
(Continued)

(58) Field of Classification Search
CPC .. E05B 47/0012; E05B 65/1046; E05B 65/10; Y10S 292/65; Y10T 70/7062;
(Continued)

(56) References Cited

U.S. PATENT DOCUMENTS 1,948,217 A 2/1934 Goodwin
2,366,613 A 1/1945 Gotthard
(Continued)

FOREIGN PATENT DOCUMENTS

EP 0233094 A1 8/1987
EP 0485248 A1 5/1992
(Continued)

OTHER PUBLICATIONS

Office Action for U.S. Appl. No. 12/616,564; dated Nov. 8, 2011.
(Continued)

*Primary Examiner* — Mark A Williams
(74) *Attorney, Agent, or Firm* — Koppel, Patrick, Heybl & Philpott

(57) ABSTRACT

An electric latch retraction device comprising a housing for receiving a plurality of internal components of the electric latch retraction device. An actuator mechanism is included in the housing, the actuator mechanism is adapted to impart linear movement on a latch, such that the latch is retracted towards the housing. A holding mechanism is also included in the housing, the holding mechanism holds the latch in a fully retracted position when the actuator is off. Other embodiments can comprise internal conversion mechanisms to convert the motor's linear motion to a different directional motion, with the different directional motion retracting the latch.

25 Claims, 11 Drawing Sheets

Related U.S. Application Data which is a continuation of application No. 12/616,564, filed on Nov. 11, 2009, now Pat. No. 8,851,530.

(60) Provisional application No. 61/199,560, filed on Nov. 17, 2008.

(51) Int. Cl.
*E05B 47/02* (2006.01)
*E05B 63/00* (2006.01)
*E05B 65/10* (2006.01)

(52) U.S. Cl.
CPC ..... *E05B 65/1046* (2013.01); *E05B 65/1053* (2013.01); *E05B 47/0006* (2013.01); *E05B 63/0065* (2013.01); *E05B 65/1093* (2013.01); *E05B 2047/0016* (2013.01); *E05B 2047/0023* (2013.01); *E05B 2047/0067* (2013.01); *Y10S 292/65* (2013.01); *Y10T 70/5159* (2015.04); *Y10T 292/097* (2015.04); *Y10T 292/0908* (2015.04); *Y10T 292/1014* (2015.04); *Y10T 292/1021* (2015.04); *Y10T 292/1082* (2015.04); *Y10T 292/11* (2015.04)

(58) Field of Classification Search
CPC ..... Y10T 292/0908; Y10T 292/097; Y10T 292/1021; Y10T 292/1082; Y10T 70/5159; E05C 9/04
USPC ..... 292/92
See application file for complete search history.

(56) References Cited

U.S. PATENT DOCUMENTS

| | | | | |
|---|---|---|---|---|
| 2,504,408 | A | 4/1950 | Griffin | |
| 2,765,648 | A | 10/1956 | Hatcher | |
| 3,576,119 | A | 4/1971 | Harris | |
| 3,614,145 | A | 10/1971 | Zawadzki | |
| 3,767,238 | A | 10/1973 | Zawadzki | |
| 3,854,763 | A | 12/1974 | Zawadzki et al. | |
| 4,006,471 | A | 2/1977 | Pappas | |
| 4,167,280 | A | 9/1979 | Godec et al. | |
| 4,257,631 | A | 3/1981 | Logan | |
| 4,328,985 | A | 5/1982 | Logan | |
| 4,344,647 | A | 8/1982 | VanDerLinden | |
| 4,351,552 | A | 9/1982 | VanDerLinden | |
| 4,354,699 | A | 10/1982 | Logan | |
| 4,384,738 | A | 5/1983 | Floyd | |
| 4,509,347 | A * | 4/1985 | Young | E05L 347/0002 292/140 |
| 4,519,640 | A | 5/1985 | Mombelli | |
| 4,545,606 | A | 10/1985 | Vodra | |
| 4,631,528 | A | 12/1986 | Handel et al. | |
| 4,652,028 | A | 3/1987 | Logan et al. | |
| 4,709,950 | A | 12/1987 | Zortman | |
| 4,720,128 | A | 1/1988 | Logan et al. | |
| 4,784,415 | A | 11/1988 | Malaval | |
| 4,796,931 | A | 1/1989 | Heid | |
| 4,801,163 | A | 1/1989 | Miller | |
| 4,821,456 | A | 4/1989 | Nogaki | |
| 4,875,722 | A | 10/1989 | Miller et al. | |
| 4,976,476 | A | 12/1990 | Cross et al. | |
| 5,072,973 | A | 12/1991 | Gudgel et al. | |
| 5,169,185 | A | 12/1992 | Slaybaough et al. | |
| 5,219,385 | A | 6/1993 | Yeh | |
| 5,246,258 | A | 9/1993 | Kerschenbaum et al. | |
| 5,322,332 | A | 6/1994 | Toledo et al. | |
| 5,340,171 | A | 8/1994 | Slaybaough et al. | |
| 5,410,301 | A | 4/1995 | Dawson et al. | |
| 5,429,399 | A | 7/1995 | Geringer et al. | |
| 5,507,120 | A | 4/1996 | Current | |
| 5,605,362 | A | 2/1997 | Surko, Jr. | |
| 5,630,631 | A | 5/1997 | Iwamoto et al. | |
| 5,823,582 | A | 10/1998 | Frolov et al. | |
| 5,988,708 | A | 11/1999 | Frolov et al. | |
| 6,009,732 | A * | 1/2000 | Haeck | E05B 17/06 292/92 |
| 6,048,000 | A | 4/2000 | Geringer et al. | |
| 6,104,594 | A | 8/2000 | Frolov et al. | |
| 6,116,661 | A | 9/2000 | Overbey et al. | |
| 6,189,939 | B1 | 2/2001 | Zehrung | |
| 6,324,789 | B1 | 12/2001 | Stephen | |
| 6,386,597 | B1 | 5/2002 | Walsh | |
| 6,394,508 | B1 | 5/2002 | Zehrung | |
| 6,565,130 | B1 * | 5/2003 | Walsh | E05B 47/0002 292/201 |
| 6,769,723 | B2 | 8/2004 | Cohrs et al. | |
| 6,786,519 | B2 | 9/2004 | Gartner | |
| 7,000,954 | B2 | 2/2006 | Cohrs et al. | |
| 7,102,475 | B2 | 9/2006 | Nakagawa et al. | |
| 7,484,777 | B2 | 2/2009 | Condo et al. | |
| 7,503,597 | B2 | 3/2009 | Cohrs et al. | |
| 7,536,885 | B1 | 5/2009 | Ross et al. | |
| 7,862,091 | B2 | 1/2011 | Escobar | |
| 7,883,123 | B2 | 2/2011 | Condo et al. | |
| 2004/0189018 | A1 | 9/2004 | Geringer et al. | |
| 2005/0104381 | A1 | 5/2005 | Whitaker et al. | |
| 2006/0082162 | A1 * | 4/2006 | Escobar | E05B 47/023 292/144 |
| 2008/0295550 | A1 * | 12/2008 | Schmidt | E05B 65/10 70/144 |
| 2009/0127869 | A1 | 5/2009 | Condo et al. | |
| 2010/0123323 | A1 * | 5/2010 | Geringer | E05B 47/0012 292/164 |
| 2010/0218569 | A1 | 9/2010 | Hunt et al. | |
| 2011/0047874 | A1 | 3/2011 | Lowder et al. | |
| 2012/0242092 | A1 * | 9/2012 | Frolov | E05B 47/026 292/92 |
| 2014/0109479 | A1 * | 4/2014 | Morstatt | E05B 47/026 49/32 |

FOREIGN PATENT DOCUMENTS

| | | | |
|---|---|---|---|
| EP | 1031688 | A1 | 8/2000 |
| EP | 1031689 | A1 | 8/2000 |
| FR | 2622240 | A1 | 4/1989 |
| FR | 2653480 | A1 | 4/1991 |
| FR | 2659379 | A1 | 9/1991 |
| JP | 11107595 | | 4/1999 |
| WO | WO9204519 | A1 | 3/1992 |
| WO | WO06025769 | A1 | 2/2006 |
| WO | WO08010876 | A2 | 1/2008 |

OTHER PUBLICATIONS

Office Action for U.S. Appl. No. 12/616,564; dated Oct. 31, 2012.
Office Action for U.S. Appl. No. 12/616,564; dated Apr. 24, 2013.
Office Action for U.S. Appl. No. 12/616,564; dated Mar. 14, 2014.
Office Action for U.S. Appl. No. 14/469,915; dated Apr. 22, 2016.
Office Action for U.S. Appl. No. 14/469,915; dated Nov. 1, 2016.
Omega Engineering, Stepper Motors, Aug. 27, 2008.

* cited by examiner

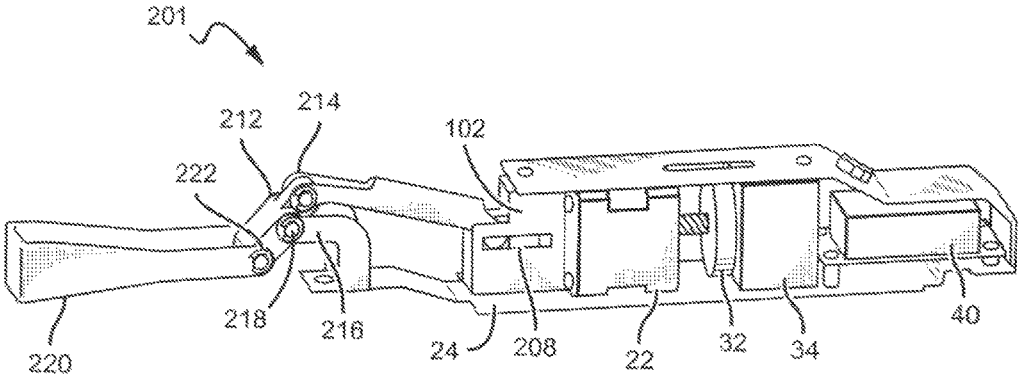
FIG. 11
FIG. 12
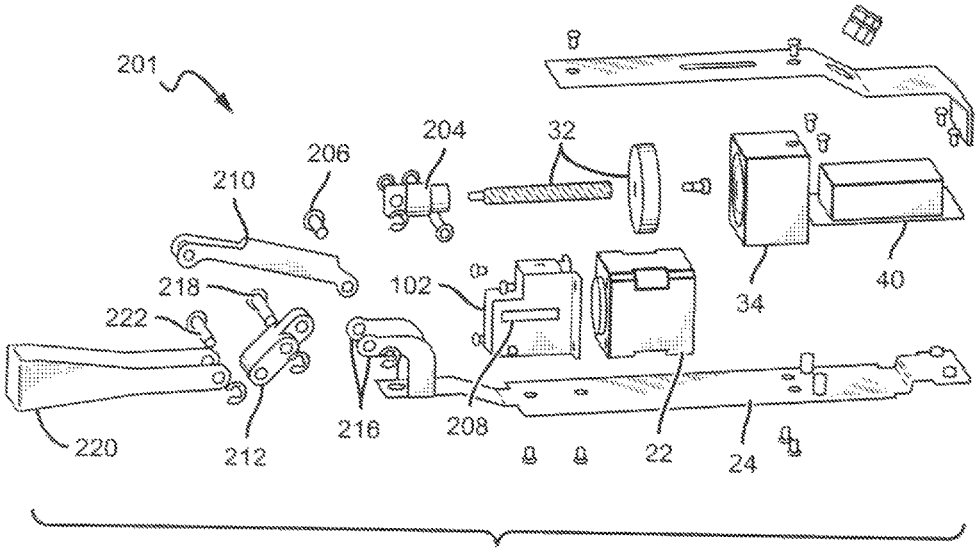

ELECTRIC LATCH RETRACTION PUSH-BAR DEVICE

This application is a continuation-in-part of and claims the benefit of U.S. patent application Ser. No. 14/469,915, to Geringer et al., filed Aug. 27, 2014, which is a continuation of, and claims the benefit of, U.S. patent application Ser. No. 12/616,564 to Geringer et al, filed on Nov. 11, 2009 (now U.S. Pat. No. 8,851,530), which claims the benefit of provisional application Ser. No. 61/199,560 to Geringer et al., filed on Nov. 17, 2008.

BACKGROUND OF THE INVENTION

Field of the Invention

This invention relates to latch mechanisms for doors and in particular to door latch mechanisms comprising a latch retraction bar.

Description of the Related Art

Door locking mechanisms and security doors to prevent theft or vandalism have evolved over the years from simple doors with heavy duty locks to more sophisticated egress and access control devices. Hardware and systems for limiting and controlling egress and access through doors are generally utilized for theft-prevention or to establish a secured area into which (or from which) entry is limited. For example, retail stores use such secured doors in certain departments (such as, for example, the automotive department) which may not always be manned to prevent thieves from escaping through the door with valuable merchandise. In addition, industrial companies also use such secured exit doors to prevent pilferage of valuable equipment and merchandise.

One type of a commonly used exit device is a push bar or push rail ("push bar") actuated latch retraction device installed on the inside of a door. When sufficient pressure is applied to the bar it depresses causing the door latch to retract from the door frame, allowing the door to be opened. These types of exit devices are typically required by fire or building codes and are used in public buildings where many people may be gathered. The devices allow for safe and quick egress from inside of the building, such as in the case of an emergency. These devices allow for this egress while keeping the door locked to those trying to enter the building from the outside.

U.S. Pat. No. 6,116,661 to Overbay describes an electric dogging mechanism for a push bar exit device consisting of slidable plate and armature which are attracted to an electric coil when the coil is energized. The slidable plate is connected to a push bar mechanism. After the push bar is depressed, retracting the exit device latch, the coil is energized attracting and holding the armature to the coil. This holds the push bar depressed and the latch retracted by the connection of the slidable plate to the push bar mechanism.

Electrically operated push bar exit devices can also be used in applications where they can be operated by a card reader or keypad from outside to allow access through a door that also serves as an exit bar latch retraction device from inside. Other applications allow for these devices to allow operation with power door operators, allowing the latch to retract on command such as through a timed schedule. These timed schedules can be implemented at facilities that operate on a fixed schedule, such as schools.

Some current implementations of these electric exit devices utilize solenoids to retract the latch bolt, which can require a relatively high operating current to reliably retract the latch bolt and overcome initial friction. Another current implementation uses a motor to retract the latch bolt, with the motor pulling back the bar which causes the latch bolt to retract. A switch can be included to detect when the bar reaches the fully retracted position, at which point the motor is turned off. In this design, the motor does not shut off until the push rail is fully retracted as sensed by the switch. Internal components of the exit device can bind or otherwise prevent the motor from fully retracting the latch bolt. This causes the motor to overwork and produces a continuous drive to the motor which can ultimately burn it out.

PCT International Publication No. WO 2008/010876 A2 to Sargent teaches that a stepper motor type linear actuator can be used and the retraction distance can electronically be controlled by counting the rotational steps of the motor. This electronic monitoring or "rotation counting" is claimed to be superior to having a fixed switch controlling the motor function however it is simply a means of eliminating the separate monitor switch and still suffers the same susceptibility to failure from wear of mechanical parts through the life of the device. The electronic user adjustable latch control can create more of an opportunity for device problems through miss adjustment. The means of holding the latch and linear actuator in the retracted position is accomplished by electronically holding the stepper motor in the actuator in a "stalled mode". This requires that the motor remains powered.

PCT International Publication WO 2006/015769 to Dorma also discloses a means of retracting the latch through linear movement. There is no mention of how the patented mechanism would be held in the retracted position.

SUMMARY OF THE INVENTION

The present invention provides an electric latch retraction push bar exit device that utilizes a motor to impart linear movement on the latch and to retract the latch. When the latch is retracted it is held in that position by a holding mechanism and the motor can be turned off. This allows for power saving and reduced wear on the motor and surrounding assemblies. A bias spring is included to return the latch to the latched condition if power is lost to the exit device or if the controller signals the holding mechanism to release the latch.

One embodiment of an electric latch retraction device according to the present invention comprises a housing containing an electric motor, wherein said electric motor is adapted to impart linear movement. A motion conversion mechanism is included to convert said linear movement to movement in a different direction, wherein the conversion mechanism is arranged to retract a latch towards the housing. A holding mechanism is mounted in the housing, with the holding mechanism adapted to hold said latch in a fully retracted position with a holding strength sufficient to hold said latch in its retracted position with the electric motor off.

These and other aspects and advantages of the invention will become apparent from the following detailed description and the accompanying drawings which illustrate by way of example the features of the invention.

BRIEF DESCRIPTION OF THE DRAWINGS

FIG. 11 is a perspective view of another embodiment of a latch retraction push-bar exit device according to the present invention;

FIG. 12 is a perspective view of a portion of the latch retraction push-bar exit device shown in FIG. 11;

DETAILED DESCRIPTION OF THE INVENTION

Figure 3:
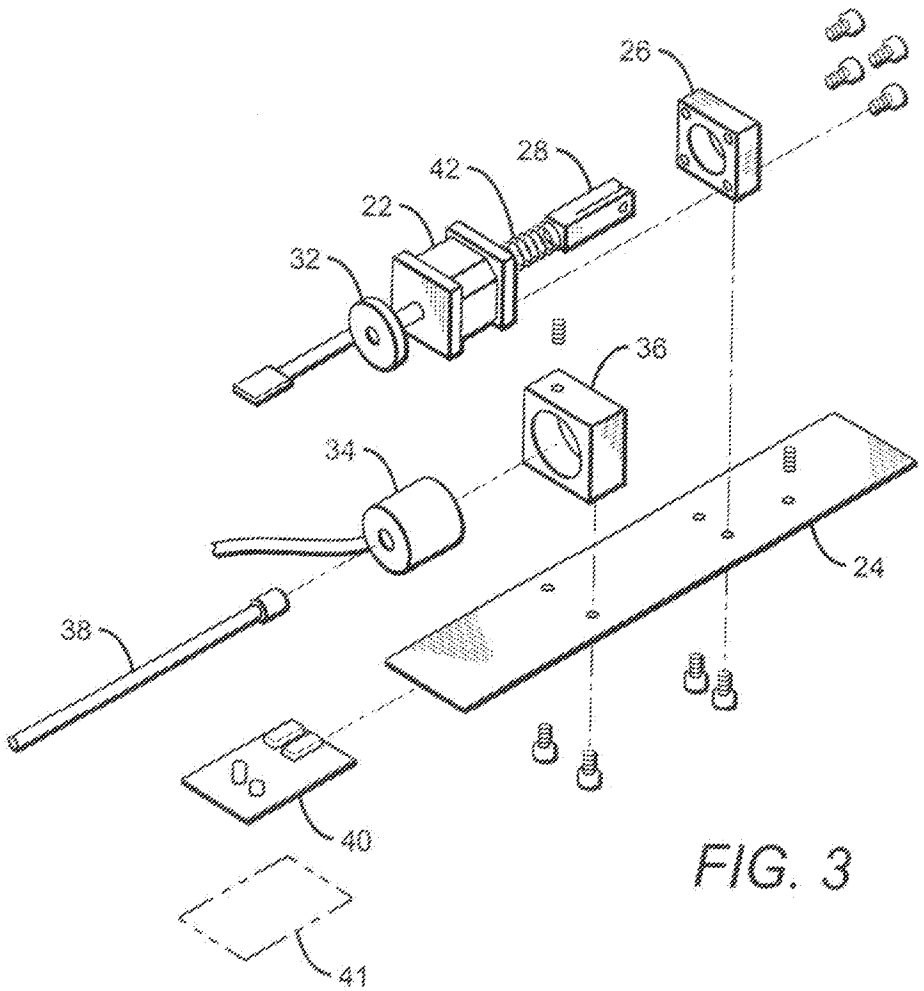
FIG. 3 is an exploded view of a motor and holding magnet assembly that can be utilized in one embodiment of an electric latch retraction push-bar exit device according to the present invention.

The present invention provides an electric latch retraction push-bar exit device ("push-bar exit device") where the latch can be retracted through the standard pushing action on the push-bar. The exit devices according to the present invention can comprise secondary mechanisms for retracting the latch, such as through an electric motor. On some embodiments, the motor can be internal to the device housing and can comprise a stepper motor type linear actuator to retract the latch. When the actuator has moved to the retracted (unlatched) position, a holding magnet can be activated to hold the actuator in the unlatched position to allowing the motor to be switched off. Many different holding magnets can be used such as a magnetic holding coil.

Upon loss of power or when controller electronics remove power from the magnetic holding coil the actuator can be returned to the at-rest or latched position. In some embodiments biasing springs can be used to return the latch to the locked position and in one embodiment a combination of an actuator biasing spring and a latch biasing spring can reverse the linear movement of the actuator and cause the device to return to the latched position.

It is understood that when an element or component is referred to as being "on", "connected to" or "coupled to" another element, it can be directly on, connected to or coupled to the other element or intervening elements may also be present. Furthermore, relative terms such as "front", "back", "inner", "outer", "upper", "above", "lower", "beneath", and "below", and similar terms, may be used herein to describe a relationship of one component of element to another. It is understood, however, that these terms are intended to encompass different orientations of the device in addition to the orientation depicted in the figures.

Although the terms first, second, etc. may be used herein to describe various elements or components these elements and components should not be limited by these terms. These terms are only used to distinguish one element or component from another element or component. Thus, a first element or component discussed below could be termed a second element or component without departing from the teachings of the present invention.

Embodiments of the invention are described herein with reference to certain illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the elements or components illustrated herein but are to include deviations in shapes that result, for example, from manufacturing. Thus, the regions illustrated in the figures are schematic in nature and their shapes are not intended to illustrate the precise shape of an element or component and are not intended to limit the scope of the invention.

Figure 1:
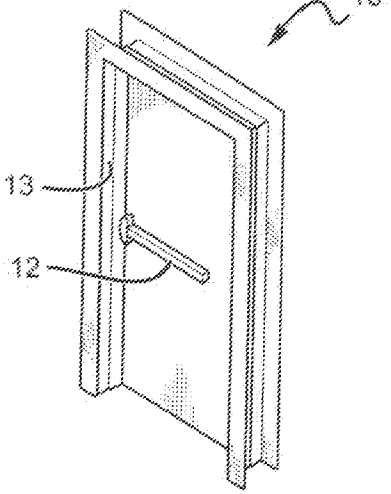
FIG. 1 is perspective view of a door utilizing one embodiment of an electric latch retraction push-bar exit device according to the present invention.
Figure 2:
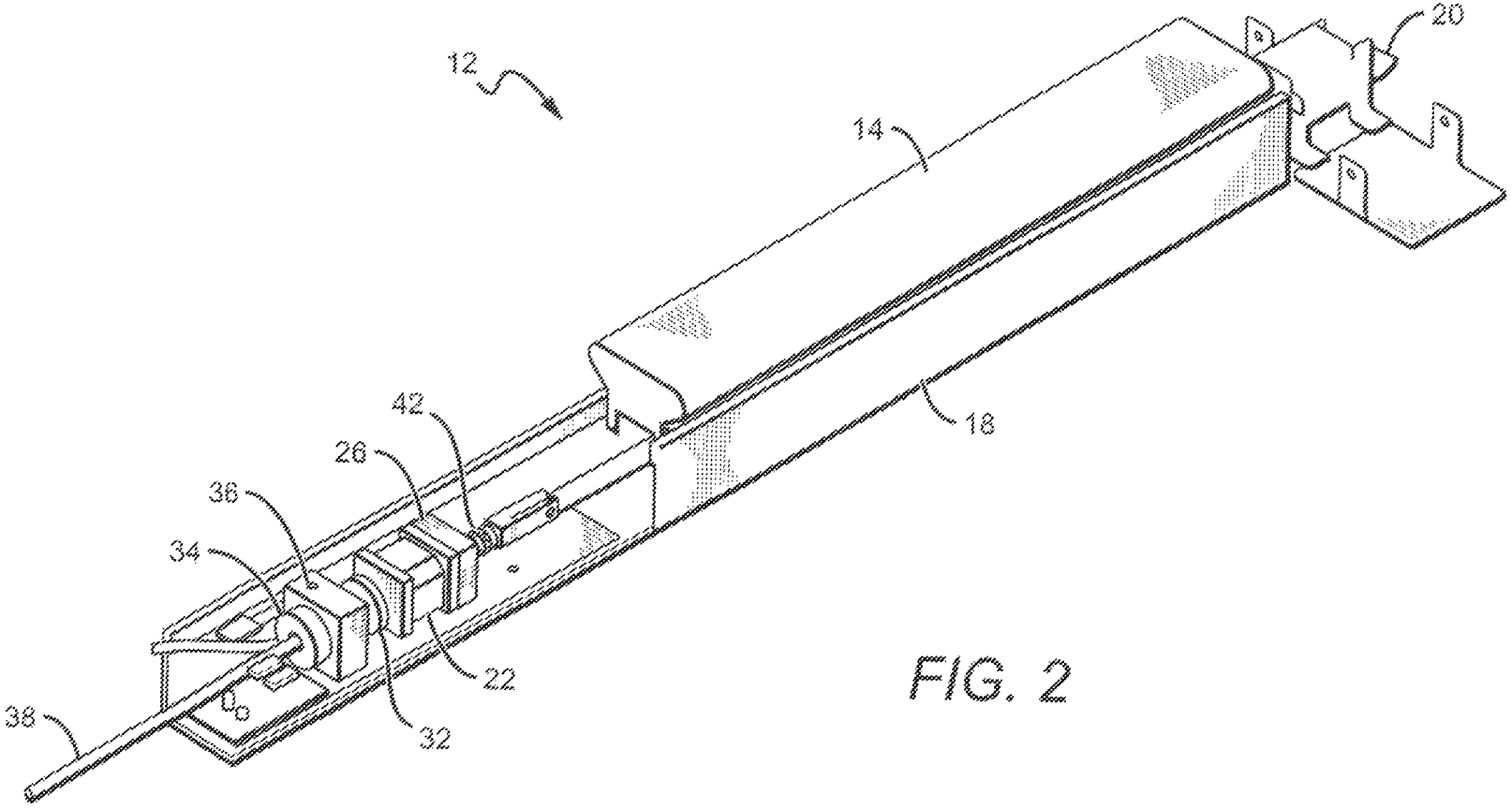
FIG. 2 is a perspective view of one embodiment of an electric latch retraction push-bar exit device according to the present invention.
Figure 4:
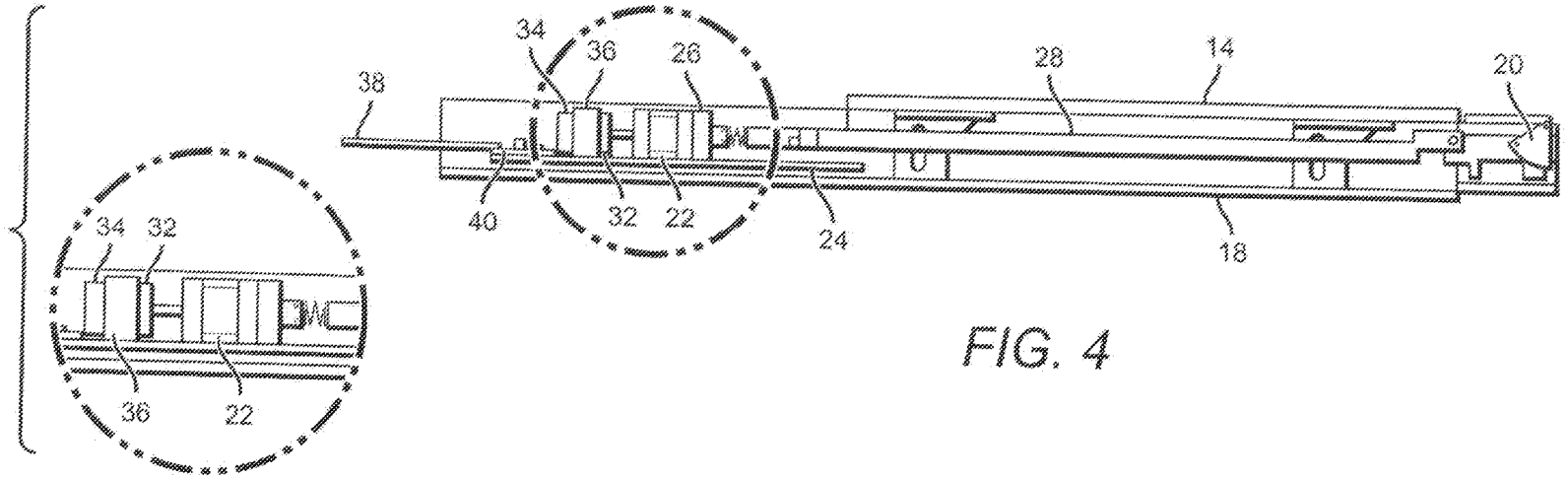
FIG. 4 is a plan view of the latch retraction push-bar exit device shown in FIG. 2 in the unlatched condition.
Figure 5:
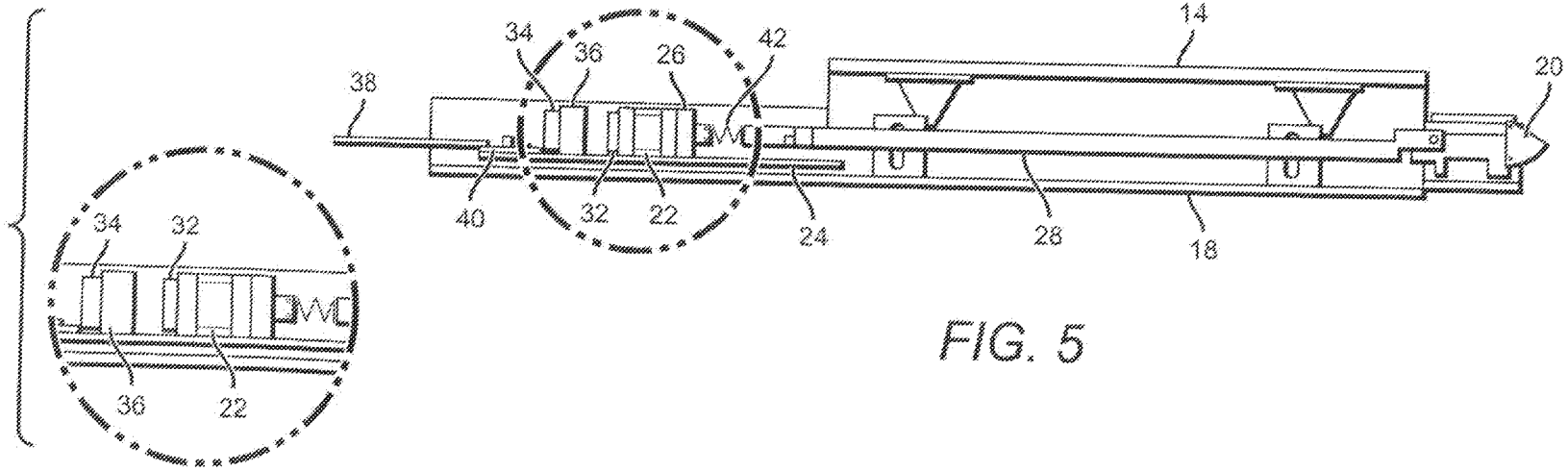
FIG. 5 is a plan view of the latch retraction push-bar exit device shown in FIG. 2 in the latched condition.
Figure 6:
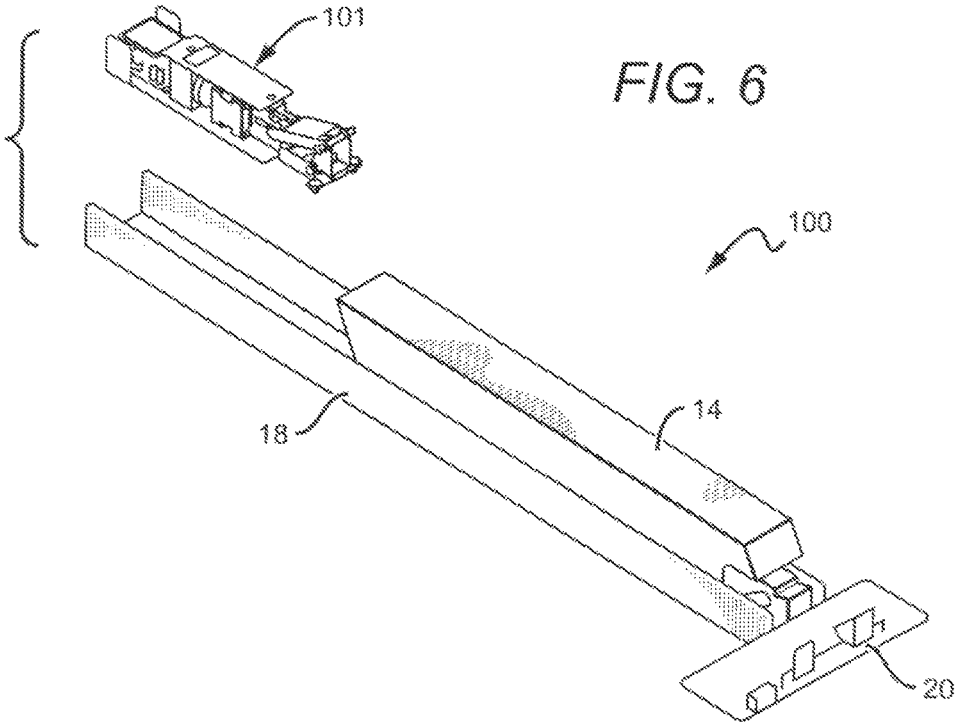
FIG. 6 is a perspective view of another embodiment of a latch retraction push-bar exit device according to the present invention.
Figure 7:
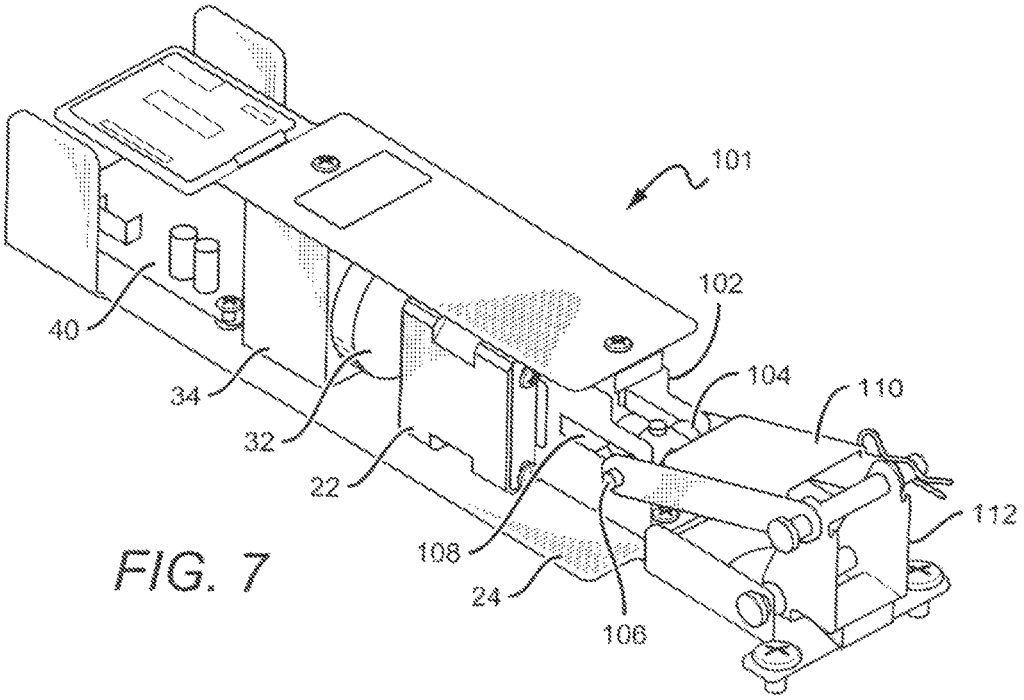
FIG. 7 is a perspective view of a portion of the latch retraction push-bar exit device shown in FIG. 6.
Figure 8:
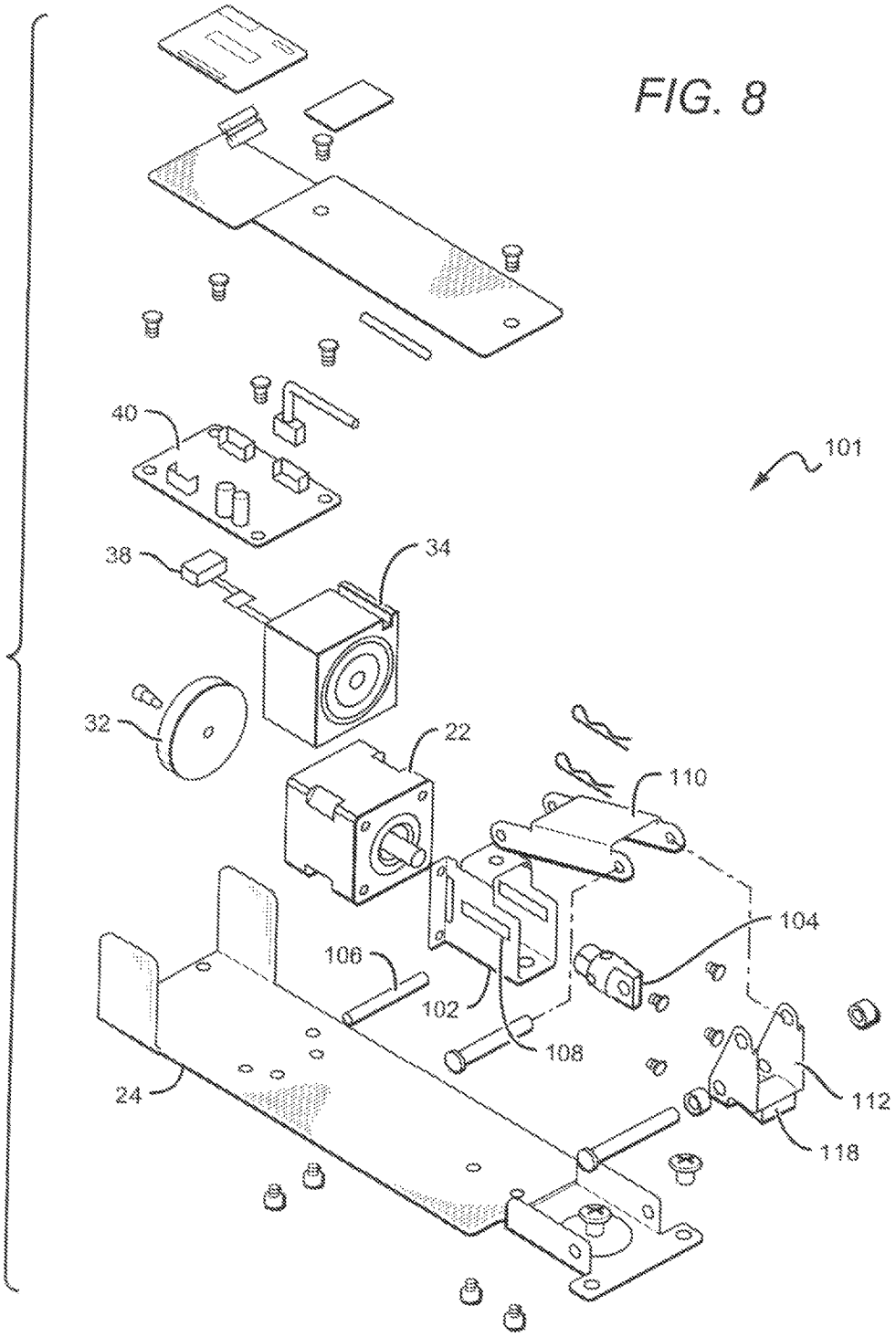
FIG. 8 is an exploded perspective view of the portion shown in FIG. 7.

FIG. 1 shows one embodiment of a door 10 utilizing a push-bar exit device 12 according to the present invention. The push-bar exit device 12 is mounted in convention manner to the door 12 with a horizontal orientation and location that allow for the exit device's latch to engage a latch opening in the door frame 13. When engaged the door 10 is prevented from opening, when the latch is retracted from latch opening the door 10 can open. As with convention devices, depressing the push-bar exit device 12 causes the latch to retract from the latch opening to allow opening of the door 10.

Referring now to FIGS. 2-5, the push-bar exit device 12 comprises a housing 18 with a push-bar 14 movably mounted to the housing so that it can be depressed. As with most conventional push-bar exit devices, this action can retract the latch 20 so that it is partially within the housing. As the push-bar 14 is depressed it causes a latch 20 to retract toward the housing. As discussed above, when the latch 20 is retracted the door utilizing the push-bar exit device 12 can be opened. Many different known mechanisms can be used to cause the latch 20 to retract as the push-bar 14 is depressed, and it is understood that each of these known mechanisms can be utilized in different embodiments of push-bar exit devices according to the present invention.

As mentioned above, push bar exit devices according to the present invention are arranged so that latch 20 can be retracted in a manner beyond the manual pushing of the push-bar 14. These can include many different types of linear actuators. In one embodiment, the latch 20 can be retracted in response to an electrical signal, and many different devices and mechanisms can be used to retract the latch 20 in response to an electrical signal. In one embodiment, an electric motor 22 can be used to retract the latch, with motor 22 mounted in place within the housing 18. An adjustment plate 24 can be included within the housing 18 with the motor 22 mounted to the adjustment plate 24 by a mounting block 36. As mentioned above, many different types of motors can be used with a suitable motor 22 such as a rotary or step motor.

The motor 22 can impart linear movement on the latch 20 using many different mechanisms. In one embodiment, the motor 22 can comprise an internal nut that turns when an electrical signal is applied to the motor 22. The housing 18 can also have internal linkage 28 that connects at one end to the latch 20 and at the other end to the motor 22. The motor end of the linkage 28 has a threaded section that mates with the motor's internal nut, and an the nut turns on the threaded section linear movement is imparted on the latch 20 through the linkage 28.

The motor further comprises an armature 32 that extends from the motor 22 as the latch 20 is retracted. A holding magnet 34 is mounted to the adjustment plate 24 by a magnet mounting block 36, with the magnet 34 in alignment with the armature 32. Many different magnets can be used, with a suitable one being an electrically actuated magnetic coil. An actuator switch/sensor 38 is mounted integral to the magnet 36 and as mentioned above, in the path of travel of the armature 32 to sense its position relative to the magnet 34.

A controller 40 can be utilized to control operation of the push-bar exit device 12, and in different embodiments the controller 40 can be remote or local to the exit device 12. The controller can communicate with the exit device using many different "hard-wire" and wireless communication links. In the embodiment shown, the controller comprises commercially available electronics interconnected in conventional way, and in different embodiments the controller 40 can perform many different functions. In the embodiment shown, when the armature 32 engages the sensor 38, the sensor 38 signals the controller 40 to turn the motor off to allow the actuator mechanism to "coast" to the fully retracted position. This coasting action is designed to compensate for manufacturing tolerances in the internal components of the exit device, including but not limited to the adjustment plate 24 and linkage 28. This allows for a "self adjusting" feature eliminating the need to readjust the device linkage as the exit device 12 wears from use.

The controller 40 is also designed to deliver a "timed" period of motor activation. This "timed" period is set to be slightly longer than is needed to retract the latch 20. The controller 40 monitors the actuator sensor 38 to determine when to remove motor power to enable the "coasting" effect and ensure a positive mating of the armature 32 against the magnet 34.

Should the sensor 38 not indicate that the latch 20 has not been retracted and "timed" motor active period has expired, the power to the motor 22 can be turned off. A rest period for motor cooling is initiated and the latch retraction cycle can be attempted again. The motor 22 will not be damaged in the event of binding of the panic device due to door alignment problems or door preload.

As mentioned above, when the actuator 32 moves to the retracted position and engages the sensor 38, the armature contacts the magnet. The magnet holds the armature 32 in the retracted position, allows the motor to be switched off while still keeping the device in the unlatched condition. This allows for keeping the exit device 12 in the unlatched condition while not consuming power by continued activation of the motor. The power needed to energize the magnet 34 is less than that consumed by the motor 22, with this arrangement realizing significant reduction in power consumption compared to similar devices without a magnet 34.

A biasing spring 42 is included on the linkage 28 biasing the linkage 28 to the latch 20 to the latched condition. If power is removed from the magnet 34, either by the controller or by loss of power to the exit device 12, the bias spring reverses the linear motion of the motor and causes the exit device 12 to return to the latched condition.

The embodiment above shows just one of many the arrangements that can be used in push-bar exit devices according to the present invention. Other embodiments can be arranged with different components arranged to operate in different ways. The push-bar exit device 12 described above directly utilizes the linear motion of motor to retract the latch. That is, the direction of linear motion provided by the motor is directly applied by the linkage to retract the latch. The linear motion in the same direction and aligned with the motor is used to retract the latch. Other push-bar exit devices according to the present invention can comprise components to convert the linear motion of the motor to a different direction or type of motion. This converted motion may more efficiently retract the latch or complement the manner in which the particular push-bar device retracts the latch. For example, some push-bar devices may rely on motion in the opposite direction of the motor, or may rely on motion that is generally orthogonal to the linear motion of the motor. In these embodiments, internal conversion mechanisms can be included to convert the linear motion of the motor to an opposite linear motion, a generally orthogonal motion, or other types of motion.

FIGS. 6-10 show another embodiment of a push-bar exit device 100 according to the present invention that can have many of the same or similar components to the embodiment described above. For the same or similar components the same reference numbers can be used as those above with the understanding the description from above applies in this embodiment and the embodiments below. Like the embodiment above, the push-bar exit device 100 comprises a housing 18 with a push-bar 14 movably mounted to the housing 18 so that it can be depressed to retract the latch 20 as described above. An electric motor assembly 101 in the housing 18 that comprises an electric actuator or motor 22 can be used to provide motion that is ultimately used to retract the latch, with motor 22 mounted on adjustment plate 24 included within the housing 18. As mentioned above, many different types of motors can be used with a suitable motor 22 such as a rotary or step motor.

In this embodiment, the motor assembly 100 comprises components that convert the linear motion of the motor 22 to motion that is more useful for retracting the latch in this embodiment of the device 100. In particular and as described in more detail below, the motor assembly comprises components that convert the linear motion of the motor 22 to a generally orthogonal motion.

The motor 22 can impart linear movement using many different mechanisms. In one embodiment, the motor 22 can comprise an internal nut that turns when an electrical signal is applied to the motor 22. In this embodiment, the motor 22 is mounted to a motor mount assembly 102 that is also mounted to the adjustment plate 24. The motor further comprises an armature 32 that extends from the motor 22 during its linear motion. A holding magnet 34 is mounted to the adjustment plate 24 with the magnet 34 in alignment with the armature 32. Many different magnets can be used, with a suitable one being an electrically actuated magnetic coil. An actuator switch/sensor 38 is mounted integral to the magnet 34 and as mentioned above, in the path of travel of the armature 32 to sense its position relative to the magnet 34. A controller 40 can be utilized to control operation of the push-bar exit device 100 and can perform many different functions as described above.

As discussed above, when the armature 32 moves to the retracted position and engages the sensor 38, the armature 32 contacts the magnet 34. The magnet 34 holds the armature 32 in the retracted position, allows the motor to be switched off while still keeping the device in the unlatched condition. An actuator 104 is attached to an armature 32 opposite the magnet 34. A first pin 106 passes through motor mount slots 108 and through the hole in the actuator 104, connecting the first pin 106 to the actuator 104. A link 110 is also connected to the first pin 106 outside of the motor mount 102. This results in the actuator 104 being connected to the link 110 by the first pin. Linear motion of the armature 32 by the motor 22 also causes linear motion of the link in the same direction, with the pin 106 riding in slots 108.

Figure 9:
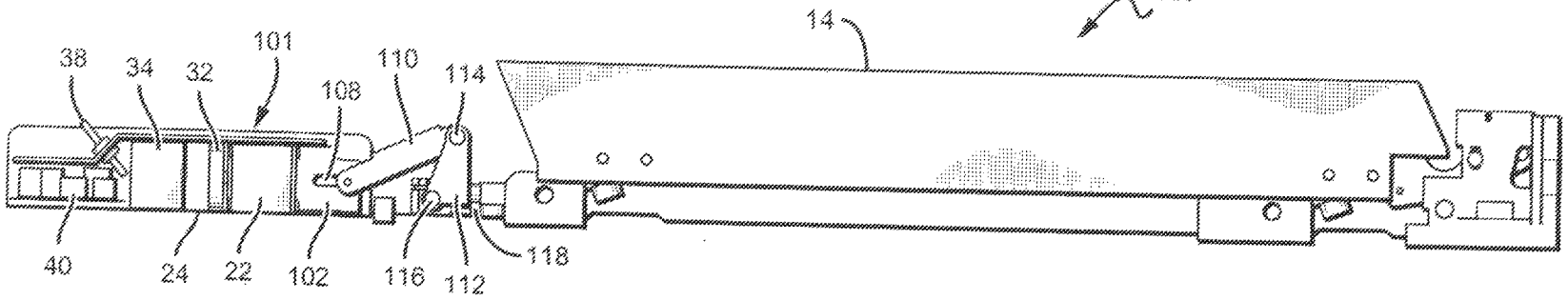
FIG. 9 a side view of the latch retraction push-bar exit device shown in FIG. 6.
Figure 10:
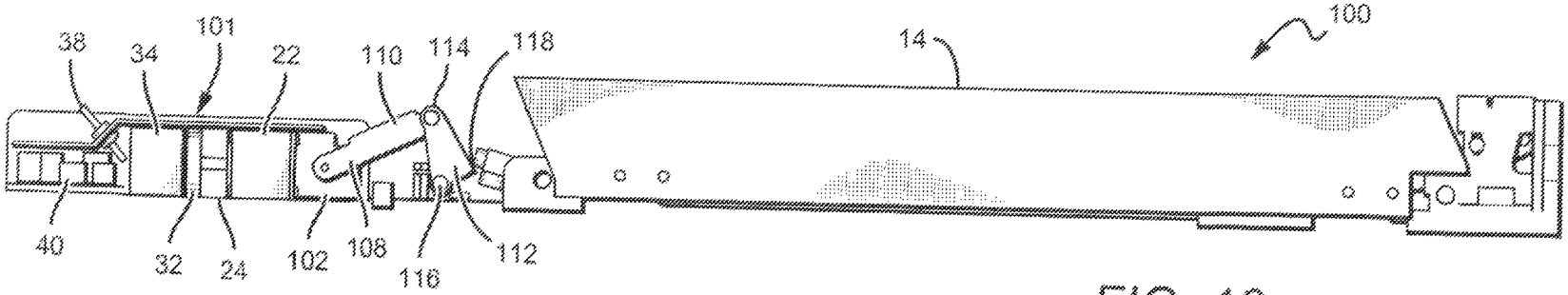
FIG. 10 is another side view of the latch retraction push-bar exit device shown in FIG. 6.

On the end opposite the first pin 106, the link 110 is connected to the top of a bellcrank 112 by a second pin 114, with the bellcrank 112 rotatable about the second pin 114. The bottom of the bellcrank 112 is mounted to the adjustment plate 24 by third pin 116, with the bellcrank rotatable about the third pin 116. In operation, the linear motion of the motor 22 causes the link 110 to move back and forth with the first pin 106 in the slots 108. This in turn causes the bellcrank 112 to rotate about the third pin 116. For example, as the link 110 is moved toward the magnet 34, the top of the bellcrank 112 is pulled toward the magnet 34 causing the bellcrank to rotate about the third pin 116. The bellcrank 112 has a lifting surface 118 that is arranged to engage with a latch retraction device that utilizes a lifting motion (generally orthogonal to the motor's linear motion) to retract the latch 20. As best shown in FIGS. 9 and 10. The lifting motion causes the push-bar 14 to depress, causing the latch to retract. As discussed above, the magnet 34 can hold the device 100 in the position with the latch retracted, with the motor 22 off.

Figure 13:
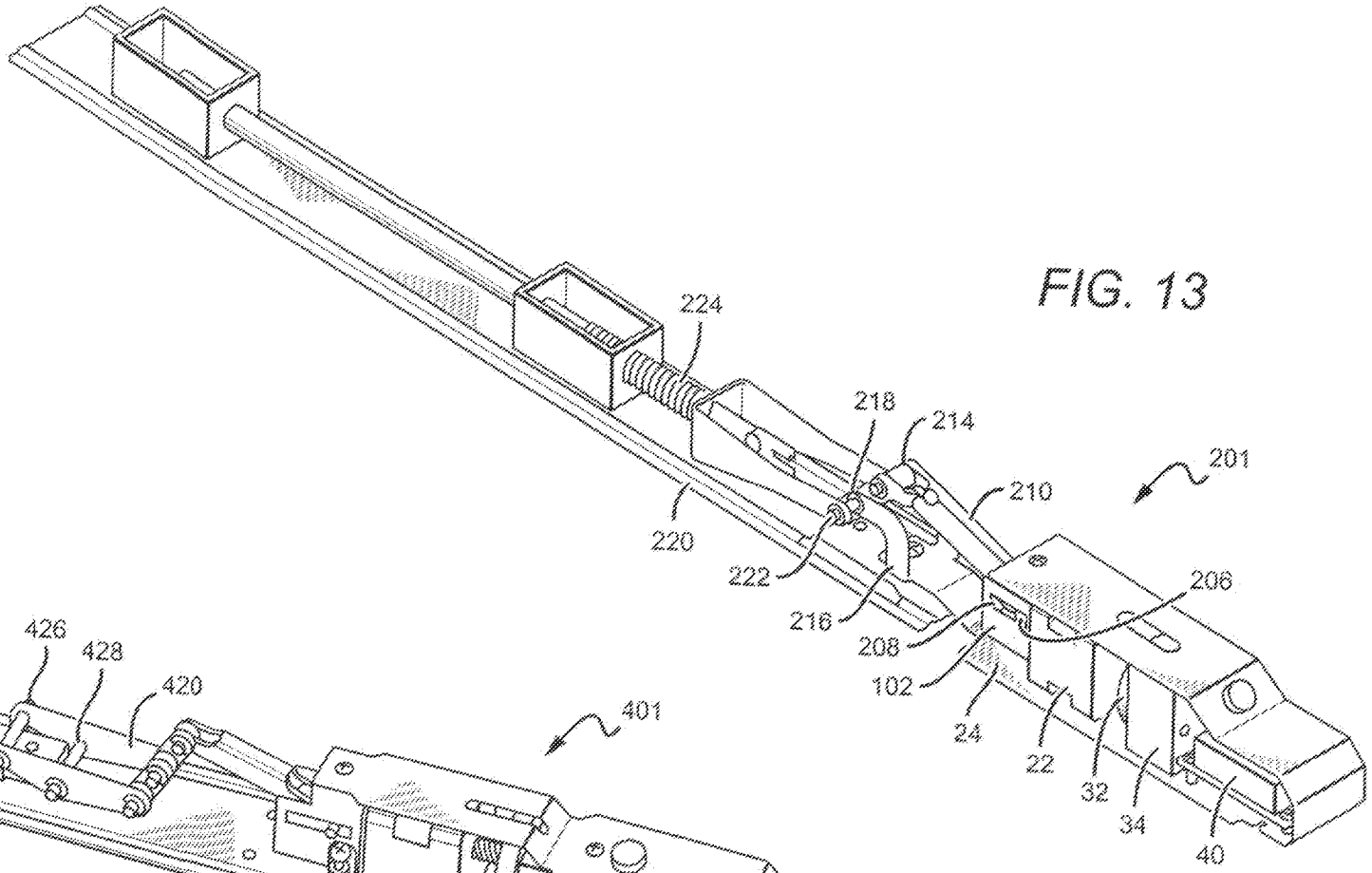
FIG. 13 is an exploded perspective view of the portion shown in FIG. 12.

FIGS. 11 through 13 show another embodiment of an electric motor assembly 201 according to the present invention that can be used in latch retraction push-bar device having a housing with a push-bar movably mounted to the housing so that it can be depressed to retract the latch (not shown) as described above. The motor assembly 201 can comprise an electric actuator or motor 22 that can be used to provide motion that is ultimately used to retract the latch. The motor 22 is mounted on adjustment plate 24, and as mentioned above, many different types of motors can be used with a suitable motor 22 being a rotary or step motor.

In this embodiment, the motor assembly 201 comprises components that convert the linear motion of the motor to motion that is more useful for retracting the latch in this embodiment. In particular, and as described in more detail below, the motor assembly 201 comprises a conversion mechanism that converts the linear motion of the motor 22 to a linear motion in the opposite direction.

Like above, the motor 22 can impart linear movement using many different mechanisms such as an internal nut that turns when an electrical signal is applied to the motor 22. In this embodiment, the motor 22 is mounted to a motor mount assembly 201 that is also mounted to the adjustment plate 24. The motor further comprises an armature 32 that extends from the motor 22 during its linear motion to engage a holding magnet 34. An actuator switch/sensor (not shown) can be mounted integral to the magnet 34 and as mentioned above, in the path of travel of the armature 32 to sense its position relative to the magnet 34. A controller 40 can be utilized to control operation of the motor assembly 201 and can perform many different functions as described above.

As mentioned above, when the armature 32 moves to the retracted position and engages the sensor, the armature 32 contacts the magnet 34. The magnet 34 holds the armature 32 in the retracted position, allows the motor to be switched off while still keeping the device in the unlatched condition. An actuator 204 is attached to an armature 32 opposite the magnet 34. A first pin 206 passes through motor mount slots 208 and through the hole in the actuator 204, connecting the first pin 206 to the actuator 204. A link 210 is also connected to the first pin 206 outside of the motor mount 202. This results in the actuator 204 being connected to the link 210 by the first pin. Like the embodiment above, linear motion of the armature 32 by the motor 22 also causes linear motion of the link 210 in the same direction, with the pin 206 riding in slots 208.

On the end opposite the first pin 206, the link 210 is connected to the top of a bellcrank 212 by a second pin 214, with the bellcrank 212 rotatable about the second pin 214. The middle of the bellcrank 212 is mounted to adjustment plate arms 216 by a third pin 218, with the bellcrank 212 rotatable about the third pin 218. A pusher strap 220 is connected to the bottom of the bellcrank 212 by a fourth pin 222, with the bellcrank 212 and pusher strap 220 rotatable about the fourth pin 222. The pusher strap 220 is connected to a latch retraction mechanism 224 that retracts a latch in response to a linear motion away from the motor assembly 201.

In operation, the linear motion of the motor 22 causes the link 210 to move back and forth with the first pin 206 in the slots 208. This in turn causes the bellcrank 212 to rotate about the third pin 218. For example, as the link 210 is moved toward the magnet 36, the top of the bellcrank 212 is pulled toward the magnet 34 causing the bellcrank 212 to rotate about the third pin 218. This in turn causes the bottom of the bellcrank 212 to move away from the motor 22. This in turn causes the pusher strap 220 to move away from the magnet 34. This arrangement allows for the linear motion of the motor 22 to cause linear motion of the pusher strap 220 in the opposite direction. For this particular push-bar retraction device using the motor assembly 201, this opposite linear motion causes the latch to retract. As above, the magnet can hold the assembly 201 in a position with the latch retracted, with the motor 22 off.

FIGS. 14 through 17 show another embodiment of a push-bar exit device 300 according to the present invention that comprises a motor assembly 301 that can be arranged in a housing (not shown) with a push-bar 14 movably mounted to the housing so that it can be depressed to retract the latch (not shown) as described above. As described above, the motor assembly 301 can comprise an electric actuator or motor 22 can be used to provide motion that is ultimately used to retract the latch, with motor 22 mounted on adjustment plate 24.

In this embodiment, the motor assembly 301 comprises components that convert the linear motion of the motor to generally orthogonal motion. However, in device 100 described above, the generally orthogonal motion was away from device 100 with the linear motion of the motor 22 toward the magnet 34. In this embodiment, the motor assembly comprises conversion mechanisms that convert the motor's linear motion toward the magnet to generally orthogonal motion toward the device 300.

Like above, the motor 22 can impart linear movement using many different mechanisms such as an internal nut that turns when an electrical signal is applied to the motor 22. In this embodiment, the motor 22 is mounted to a motor mount assembly 302 that is also mounted to the adjustment plate 24. The motor assembly 301 further comprises an armature 32 that extends from the motor 22 during its linear motion to engage a holding magnet 34. An actuator switch/sensor 38 can be mounted integral to the magnet 34 and as mentioned above, in the path of travel of the armature 32 to sense its position relative to the magnet 34. A controller 40 can be utilized to control operation of the motor assembly 301 and can perform many different functions as described above.

As mentioned above, when the armature 32 moves to the retracted position and engages the sensor, the armature 32 contacts the magnet 34. The magnet 34 holds the armature 32 in the retracted position, allows the motor to be switched off while still keeping the device in the unlatched condition. An actuator (not shown) is attached to an armature 32 opposite the magnet 34. A first pin 306 passes through motor mount slots 308 and through the hole in the actuator as described above, connecting the first pin 306 to the actuator. A bellcrank 310 is also connected to the motor mount assembly 302 by the first pin 306 that passes through bellcrank slots 312.

The bellcrank 310 is also mounted to adjustment plate walls 314 by a second pin 316, with the bellcrank 310 rotatable about the second pin 316. The bottom of the bellcrank 310 is connected to the latch retraction mechanisms by third pin 318. A biasing spring 320 can be included to bias the bellcrank to the upper position in the event that power is lost to the motor 22 and/or magnet 36.

In operation, the linear motion of the motor 22 causes the first pin 306 to with the motor's linear motion. This in turn causes the bellcrank 310 to also move. As the armature 32 is moved toward the magnet 34 by the motor 22, the bellcrank 310 rotates about the second pin 316. This in turn causes the bottom of the bellcrank 310 to rotate down and orthogonal to the motor's linear motion, to depress the push-bar 14 (best shown in comparing FIGS. 16 and 17). This arrangement allows for the linear motion of the motor 22 to cause generally orthogonal motion, with the movement of the armature 32 toward the magnet causing an orthogonal motion opposite of that in device 100 described above.

Figure 18:
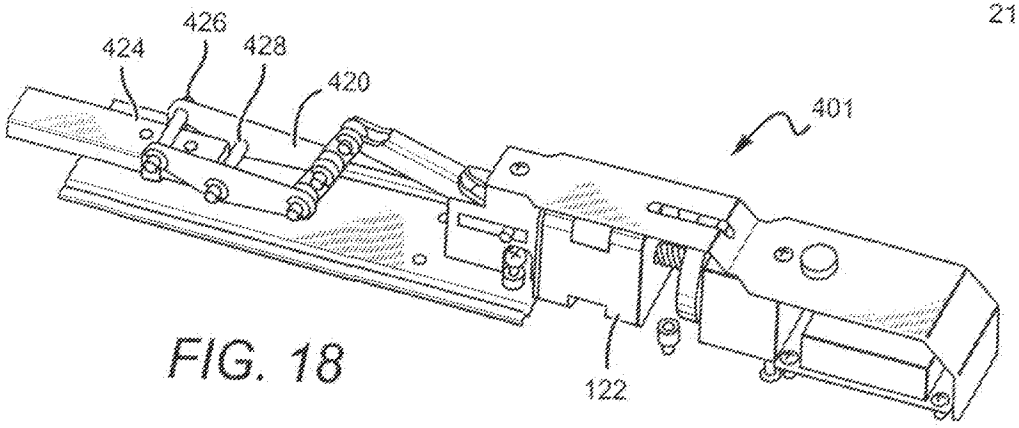
FIG. 18 is a perspective view of another embodiment of a latch retraction push-bar exit device according to the present invention.
Figure 14:
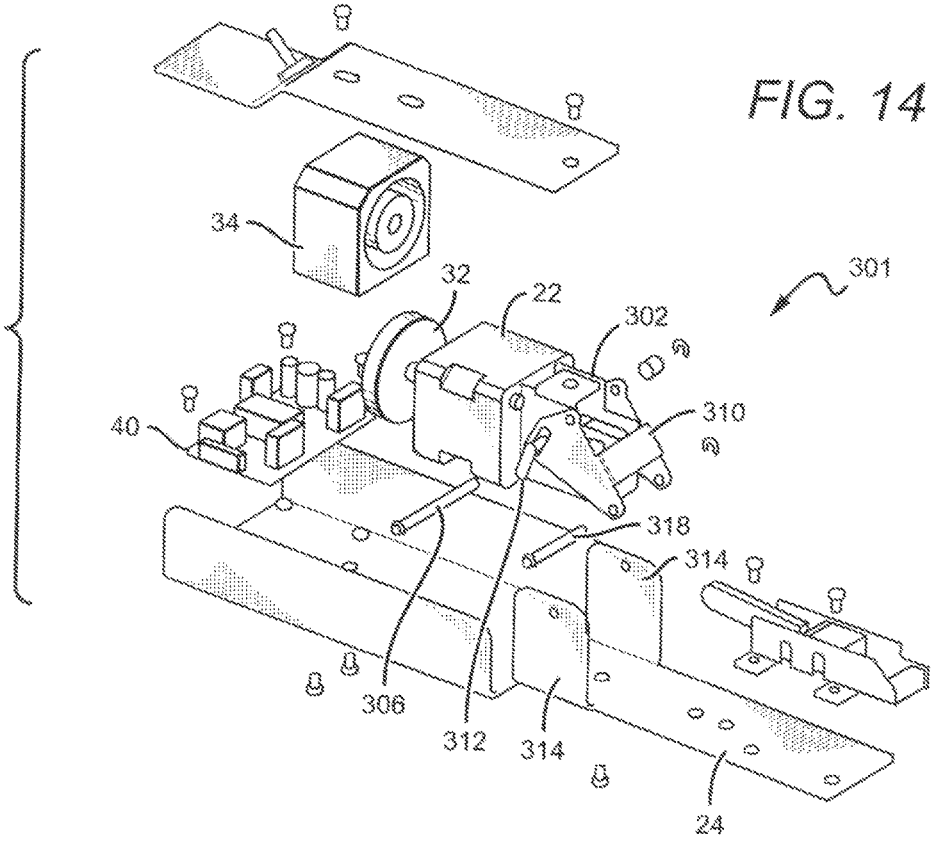
FIG. 14 is a perspective exploded view of a portion of another embodiment of a latch retraction push-bar exit device according to the present invention.
Figure 15:
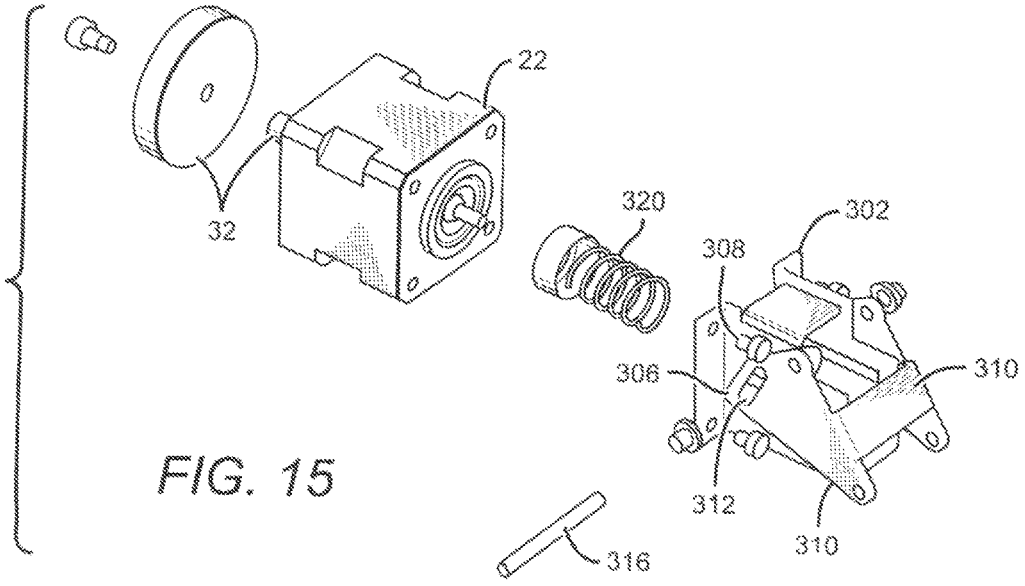
FIG. 15 is a perspective exploded view of a portion of the embodiment of a latch retraction push-bar exit device shown in FIG. 14.
Figure 16:
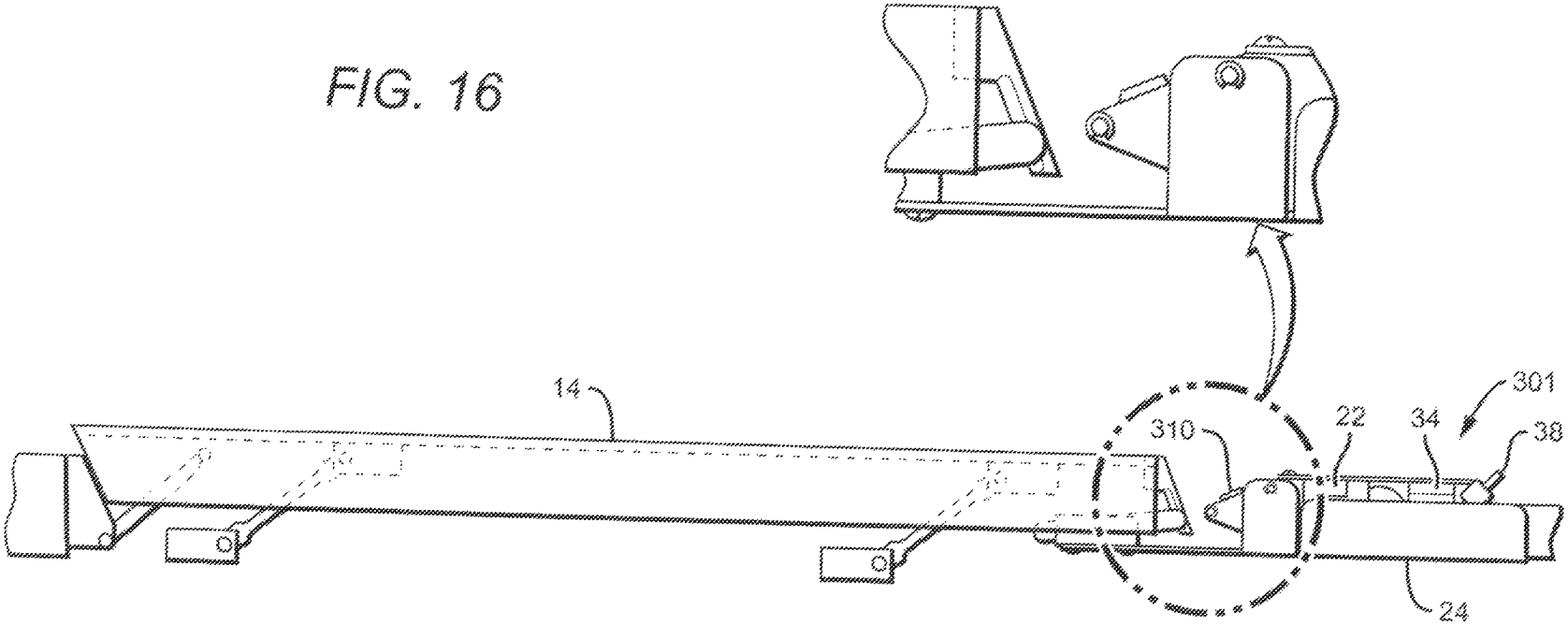
FIG. 16 is a side view of a latch retraction push-bar exit device utilizing the portion shown in FIG. 14.
Figure 17:
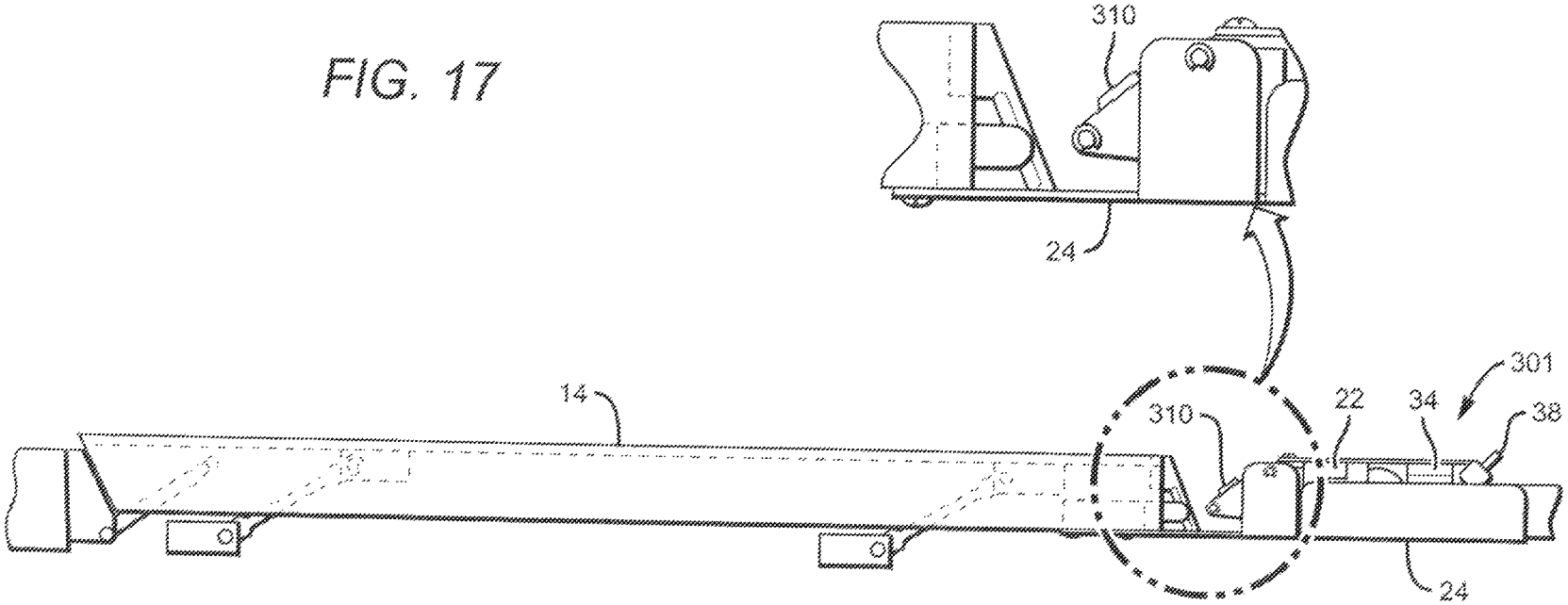
FIG. 17 is another side view of a latch retraction push-bar exit device utilizing the portion shown in FIG. 14.

FIG. 18 shows another embodiment of a motor assembly 401 according to the present invention that is similar to the motor assembly 201 described above. It has many of the same components and is similarly arranged to provide linear motion that is opposite that of the motor 22. In this embodiment, however, the pusher strap 420 is not connected to latch retraction mechanism 424. Instead, the pusher strap 420 abuts the latch retraction mechanism at the first and second cross-bars 426, 428. The motion of pusher strap 420 away from the motor 22 causes the pusher strap to impart a pushing motion on the latch retraction mechanism 424. The latch retraction mechanism can be comprise a biasing string such that is remains abutted against and moves with the pusher strap as it moves in the opposite direction toward the motor 22.

It is understood that the embodiments of the present invention can be used in many different push-bar devices arranged in many different ways. Although the present invention has been described in detail with reference to certain configurations thereof, other versions are possible. Therefore, the spirit and scope of the invention should not be limited to the versions described above.

We claim:

1. An electric latch retraction device comprising:

a housing containing an electric motor, wherein said electric motor is adapted to impart linear movement in a first direction;

a motion conversion mechanism arranged to convert said linear movement in said first direction to movement in a second direction, wherein said first direction is different from said second direction, wherein said conversion mechanism is arranged to retract a latch towards said housing;

a holding mechanism mounted in said housing, said holding mechanism adapted to hold said latch in a fully retracted position with a holding strength sufficient to hold said latch in its retracted position with said electric motor off; and an armature adapted to extend from said electric motor and engage said holding mechanism when said latch is fully retracted.

2. The electric latch retraction device of claim 1, wherein said linear movement in said first direction is toward said holding mechanism and said opposite linear motion is away from said holding mechanism.

3. The electric latch retraction device of claim 1, wherein said motion conversion mechanism converts said linear movements to a direction that is substantially orthogonal to said linear movement.

4. The electric latch retraction device of claim 3, wherein said linear motion is toward said holding mechanism and said substantially orthogonal motion is away from said electric latch retraction device.

5. The electric latch retraction device of claim 3, wherein said linear motion is toward said holding mechanism and said substantially orthogonal motion is toward said electric latch retraction device.

6. The electric latch retraction device of claim 1, wherein said conversion mechanism comprises a bellcrank.

7. The electric latch retraction device of claim 1, wherein said conversion mechanism comprises a link and a bellcrank.

8. The electric latch retraction device of claim 1, wherein said armature extends from said electric motor as said latch is retracted towards said housing.

9. The electric latch retraction device of claim 1, wherein said armature is magnetically conductive.

10. The electric latch retraction device of claim 1, wherein said holding mechanism is magnetically conductive.

11. The electric latch retraction device of claim 1, wherein said holding mechanism is an electrically actuated magnetic coil.

12. The electric latch retraction device of claim 1, said electric motor comprising an internal mechanism adapted to receive an internal linkage.

13. The electric latch retraction device of claim 12, wherein said internal linkage couples said latch to said electric motor, said internal linkage adapted to mate with said internal mechanism.

14. The electric latch retraction device of claim 13, said internal linkage comprising a threaded section to mate with said internal mechanism to impart linear movement on said latch.

15. The electric latch retraction device of claim 13, wherein said internal mechanism is a nut, said internal linkage mating with said nut to impart linear movement on said latch.

16. The electric latch retraction device of claim 1, wherein said electric motor is a rotary motor.

17. The electric latch retraction device of claim 1, wherein said electric motor is a step motor.

18. An electric latch retraction device comprising:

a housing containing a plurality of internal components of said electric latch retraction device, said internal components comprising an electrical actuator mechanism adapted to impart linear movement in a first direction in response to an electrical signal;

said internal components further comprising a magnet mounted in said housing;

said internal components further comprising a motion conversion mechanism arranged to convert said linear movement in said first direction to movement in a second direction, wherein said first direction is different from said second direction;

a latch wherein said different directional movement is in a direction to retract said latch, said magnet adapted to hold said internal components in a position with said latch retracted; and an armature adapted to extend from said electric motor and engage said magnet when said latch is fully retracted.

19. The electric latch retraction device of claim 18, wherein said magnet is strong enough to hold said internal components when said electrical signal is removed from said actuator mechanism.

20. The electric latch retraction device of claim 18, further comprising a bias spring in said housing, said bias spring adapted to position said latch in a latched position.

21. The electric latch retraction device of claim 18, wherein said linear movement is toward said holding mechanism and said opposite linear motion is away from said holding mechanism.

22. The electric latch retraction device of claim 18, wherein said motion conversion mechanism converts said linear movements in said first direction to a direction that is substantially orthogonal to said linear movement.

23. The electric latch retraction device of claim 22, wherein said linear motion in said first direction is toward said holding mechanism and said substantially orthogonal motion is away from said electric latch retraction device.

24. The electric latch retraction device of claim 22, wherein said linear motion in said first direction is toward said holding mechanism and said substantially orthogonal motion is toward said electric latch retraction device.

25. The electric latch retraction device of claim 18, wherein said conversion mechanism comprises a link and a bellcrank.

* * * * *